US005335616A

United States Patent [19]

Tiesler

[11] Patent Number: 5,335,616

[45] Date of Patent: Aug. 9, 1994

[54] BOAT RUDDER CONTROL SYSTEM

[76] Inventor: Robin F. Tiesler, 6175 Carversville Rd., Carversville, Pa. 18913-0044

[21] Appl. No.: 59,422

[22] Filed: May 4, 1993

[51] Int. Cl.[5] ..... B63H 25/06

[52] U.S. Cl. ..... 114/172

[58] Field of Search ..... 114/144 R, 162, 170, 114/172; 440/62, 55

[56] References Cited

U.S. PATENT DOCUMENTS

| | | | |
|---|---|---|---|
| 55,028 | 5/1866 | Dinzey . | |
| 319,665 | 6/1885 | Barney . | |
| 1,679,395 | 8/1928 | Bailey | 114/162 |
| 3,279,410 | 10/1966 | Young | 114/172 |
| 3,731,645 | 5/1973 | Pearce | 114/162 |
| 3,752,105 | 8/1973 | Hackett | 114/162 |
| 4,319,538 | 3/1982 | Macfarlane | 114/165 |
| 4,915,051 | 4/1990 | Martinek | 114/170 |
| 5,070,804 | 12/1991 | Strazzeri | 114/170 |

*Primary Examiner*—Sherman Basinger

*Attorney, Agent, or Firm*—Synnestvedt & Lechner

[57] ABSTRACT

A rudder control system for a boat rudder comprises a rudder control line extending from the tiller to guide spools displaced from the center line of the hull. The ends of the control line are joined by a resilient section which may take the form of a coil spring or resilient cord. Stop means affixed to the control line and the boat hull resiliently return the rudder to the center position. Adjustment of the tension in the cord provides for resistance to turning movement of the rudder.

17 Claims, 6 Drawing Sheets

BOAT RUDDER CONTROL SYSTEM

FIELD OF THE INVENTION

This invention relates to steering control for boats, especially small boats, and more particularly for the control and stabilizing of tiller movements in sailboats.

BACKGROUND OF THE INVENTION

A number of tiller locking or stabilizing devices have been available in the past for use for dampening the effort of forces against the rudder which tend to steer the boat off course or cause it to change course abruptly in a dangerous way. Such devices are useful when it is inconvenient to maintain control of the tiller as, for example, when one is sailing a boat single handedly and must attend to the trim of the sails, or when backing out of a slip or tending to other tasks or when it is simply desired to allow the boat to sail itself.

A known device comprises an operated clamp which clamps a line utilizing a screw operated locking knob which is affixed to the tiller. Devices of this type either clamp a portion of the line extended from the cockpit coaming to the tiller or utilize a telescoping metal sleeve which is secured to the boat and the tiller at similar locations. While these devices are generally effective, they basically brake or frictionally resist movement of the tiller and do not have the capability of returning the tiller to a predetermined position. In addition, knob operated clamps tend to snag sheets or other lines in the sailboat. Known devices of this type do not have the capability of returning the rudder to a central position once a turn has been made or when the helmsman needs to take his hand from the tiller.

SUMMARY AND OBJECTS OF THE INVENTION

In summary, a rudder control system of the present invention comprises resilient tensioning means attached to the boat tiller which frictionally resists movement of the tiller away from a generally central position within a first range of tiller movements away from the central or neutral position and which is effective beyond predefined limit positions for resiliently returning the tiller to the central position in the absence of control by the helmsman. More particularly, in its preferred form, the invention comprises a line detachably affixed to the tiller having first and second sections extending from the tiller around guide means adjacent opposite sides of the boat hull to a position centrally of the hull where the first and second sections are joined by resilient tensioning means. Stop members movable with the first and second line sections interengage a stop means affixed to the boat hull upon movement of the tiller a preselected distance away from the central position. In positions of the tiller beyond the preselected range of positions, the resilient tensioning means is effective to return the tiller, and thus the rudder, to a setting within the predetermined range, thus causing the boat to assume a straight course once a turn is made.

Objects of the invention are a tiller control system for resisting rudder movements and for controlling the tiller and associated rudder in a manner which resiliently urges the tiller to a central position in the absence of a deliberate steering force applied by the helmsman.

Another object of the invention is a rudder positioning control system which is effective to maintain the tiller and rudder in a fixed position in the absence of control by the hand of a helmsman.

A further object of the invention is a rudder control system which is simple to install and maintain.

A further object of the invention is a rudder control system which is readily adjustable to take into account variations in sailing conditions as well as the helmsman's wishes.

Another object of the invention is the provision of a rudder control system which does not interfere with use of cockpit space.

A still further object of the invention is a rudder control system which is substantially instantaneously disengageable.

The foregoing and various other objects and advantages of the invention will become more fully apparent from the detailed description of the illustrative embodiment of the invention.

DETAILED DESCRIPTION OF THE ILLUSTRATIVE EMBODIMENT OF THE INVENTION

Figure 1:
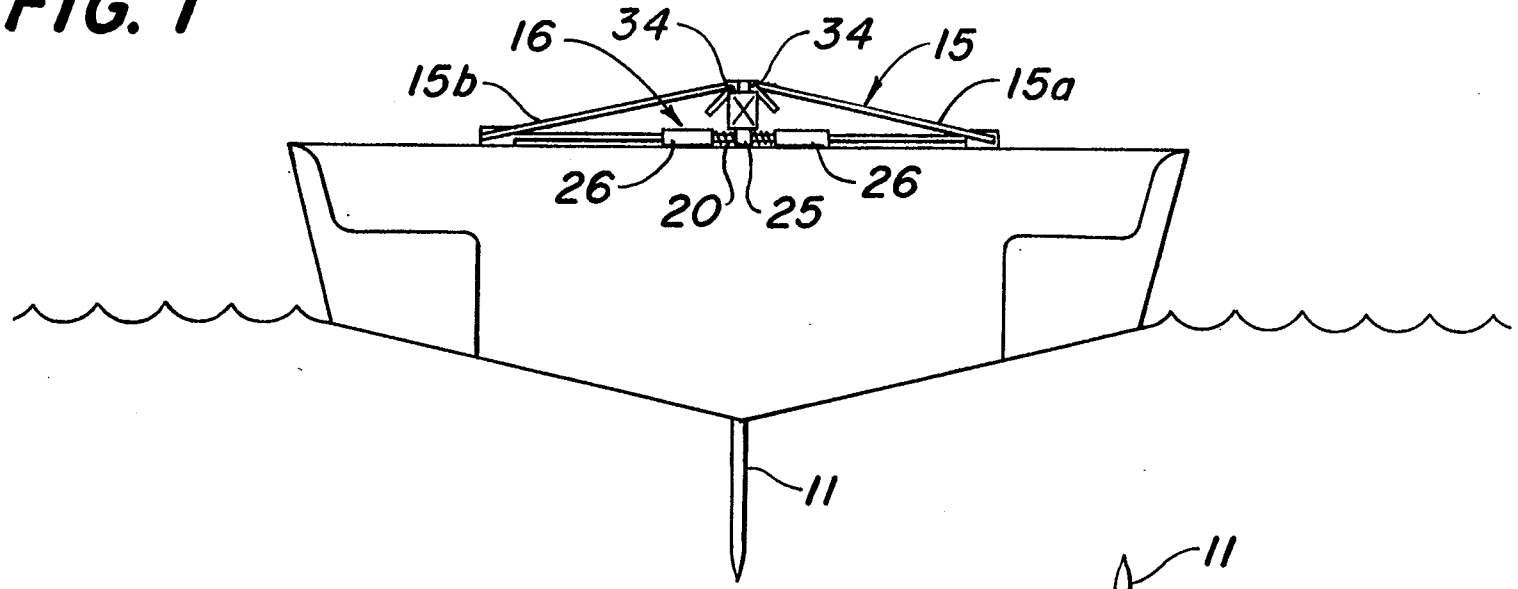
FIG. 1 is an elevational view in section showing a preferred form of the rudder control system of the present invention.
Figure 2:
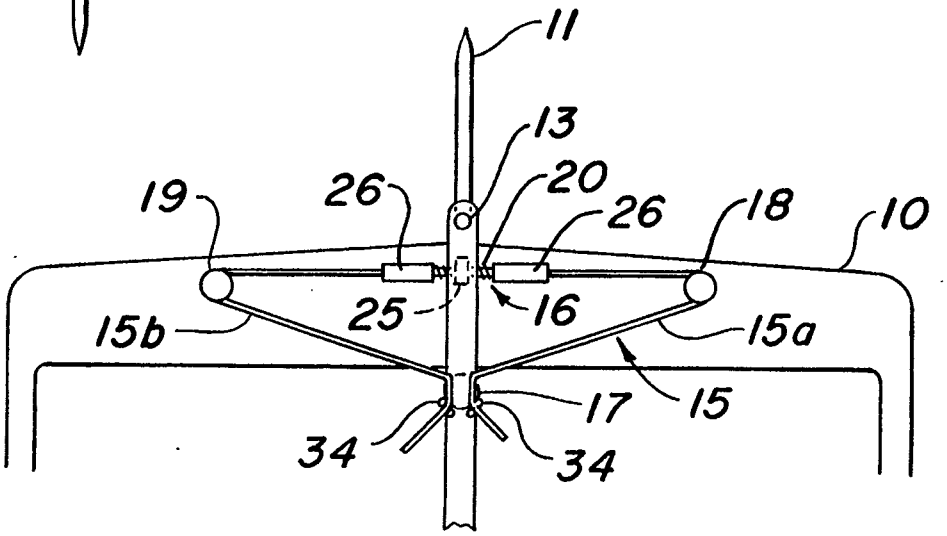
FIG. 2 is a plan view of the rudder control system of FIG. 1.

With reference in particular to FIGS. 1 and 2, the stern portion of a sailboat hull 10 is shown as having a rudder 11 interconnected to a suitable steering arm, such as tiller 12, by means of pintle 13 which provides a pivotal mounting means for the steering arm and rudder with respect to the hull. Typically, the tiller and the rudder are mounted at the center line of the stern of the hull, although other mounting locations and dual, spaced apart interconnected rudders may be employed. As is understood by those conversant in this art, side-to-side movements of tiller 12 provide turning movements of the rudder, thus allowing the craft to change and maintain course in accordance with the wishes of the helmsman.

In carrying out the invention, the control means comprises a control line 15 having a centered resilient tensioning member 16 is affixed to the tiller at a location displaced from pivot point 13.

Although the control line may be affixed in various ways, a preferred control means comprises cleat 17 illustrated in FIGS. 7 and 7A and described more particularly hereinafter. Preferably, cleat 17 allows for easy release of the control line 15 so that the rudder control system is disengaged whenever the helmsman so chooses.

Figure 6:
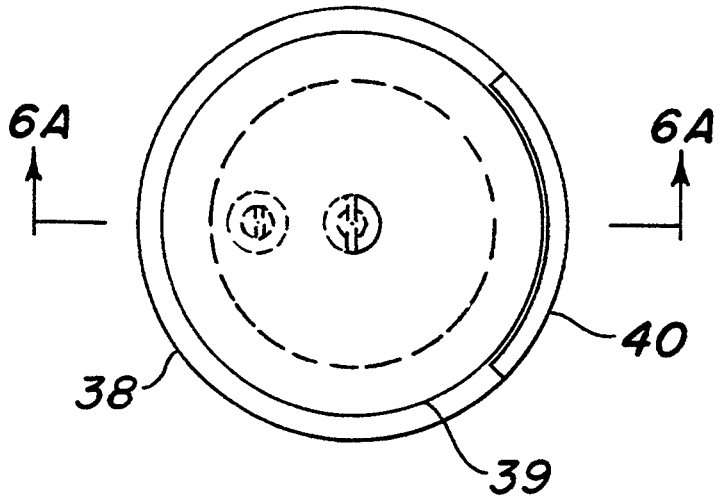
FIGS. 6 and 6A are plan and sectional views respectively, of a preferred form of guide means used in the invention.
Figure 6A:
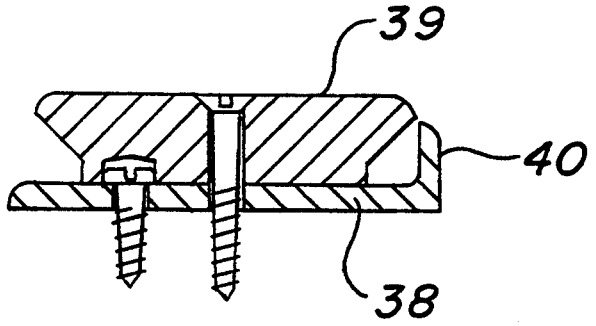

As illustrated in FIGS. 1 and 2, the control line is divided into two sections 15*a* and 15*b* which extend from cleat 17 transversely of the hull around guide means 18 and 19, which preferably comprise fixed guide spools as illustrated in FIGS. 6 and 6A. The guide means are spaced equidistantly from the hull center line adjacent to sides of the craft and frictionally guide line portions 15*a* and 15*b* around the outboard surface of each guide spool and then in paths extended towards the hull center line where they are joined by the resilient tensioning member 16.

Figure 3:
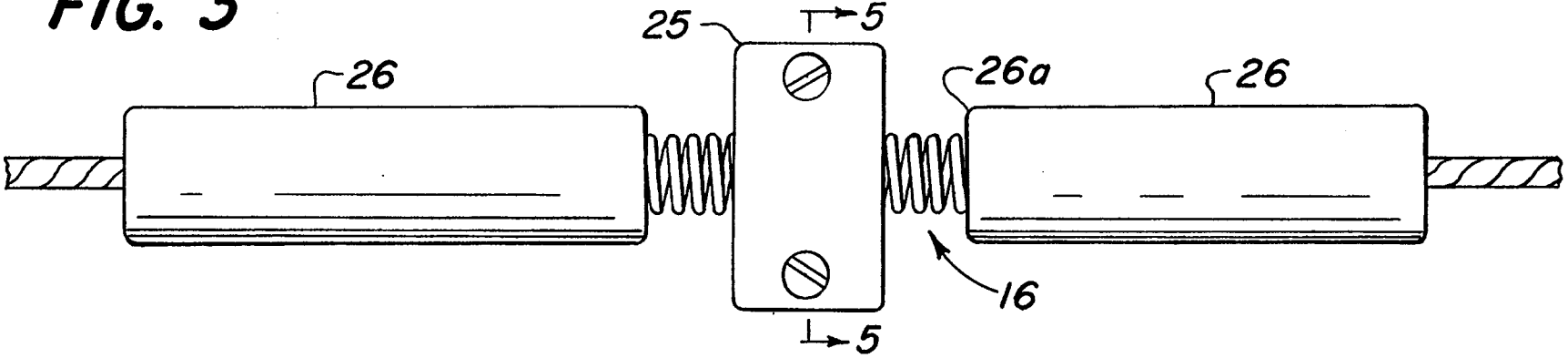
FIG. 3 is an enlarged fragmentary view in plan of a portion of the rudder control system of FIGS. 1 and 2.
Figure 4:
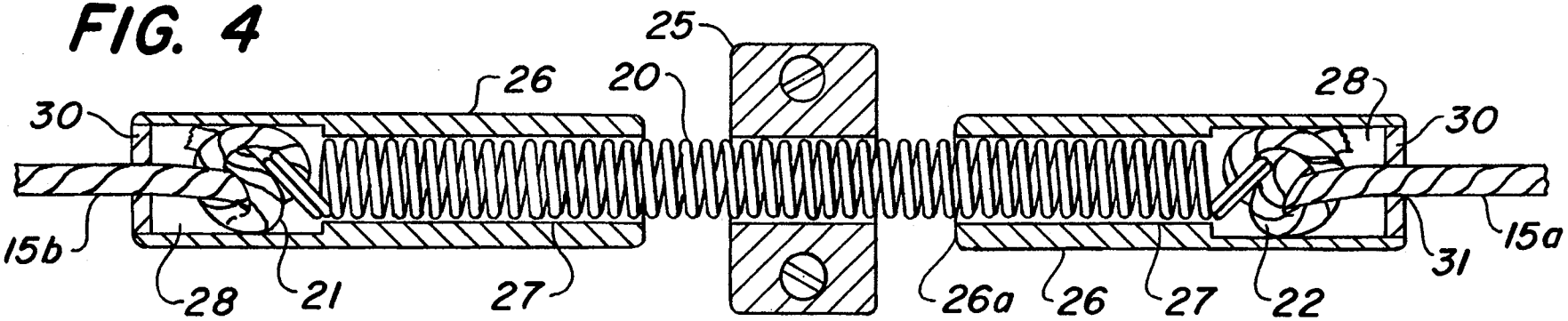
FIG. 4 is a sectional view generally taken on line 4—4 of FIG. 5.
Figure 5:
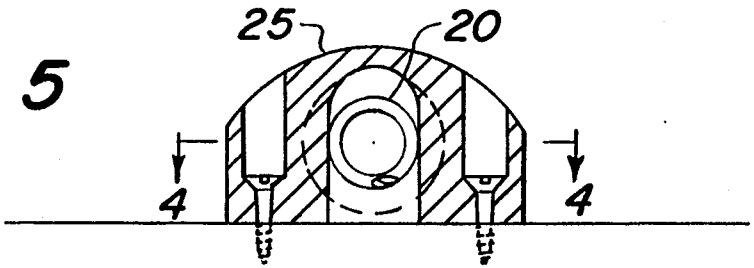
FIG. 5 is a sectional view on line 5—5 of FIG. 3.

FIGS. 3 through 5 illustrate on an enlarged scale with respect to FIGS. 1 and 2 a preferred tensioning member. As can be seen in section in FIG. 4, the tensioning member 16 preferably comprises a coiled tension spring 20 which is affixed at its ends to line portions 15*a* and 15*b* by any suitable means, such as knots 21 and 22.

The assemblage just described, including line portions 15*a* and 15*b*, resilient tensioning member 16 and the means for affixing the line to the tiller, comprises a means for adjustably maintaining a predetermined tension on the tiller which maintains the tiller in position due to the frictional interaction between the tensioned line portions 15*a* and 15*b* and the spools 18 and 19.

In its preferred form, the invention also comprises interactive stop means operative in response to tiller movements beyond a predetermined range which operate in combination with the resilient means for resiliently urging the rudder towards a position within a predetermined range of positions. In preferred form, in the embodiment of FIGS. 1 and 2, the interactive stop means comprises a center stop member 25 affixed to the stern deck of the hull and a pair of stop sleeves 26 affixed to the line portions 15*a* and 15*b*. The sleeves 26 each have a hollow bore 27 which receive the ends of coil spring 20 and a counterbored opposite end portion 28 which receives the respective ends of line portions 15*a* and 15*b*. As is best shown in FIG. 4, the ends of the line sections 15*a* and 15*b* are securely tied to the ends of spring 20. A collar 30 having an opening 31 fits into the ends of the counterbores 28 and is secured in place by any suitable means, such as an adhesive.

In use, movement of the tiller away from a central position, such as towards the right as viewed in FIG. 2, tensions the left-hand line portion 15*b* moving the right-hand sleeve 26 toward the left until its end surface 26*a* bears against center stop member 25. From this point on, further movement of the tiller in the same direction causes a stretching of the coil spring 20. Should the tiller be released, the tensioning forces within the spring are effective to return the tiller to a position in which it is substantially centered.

Figure 7:
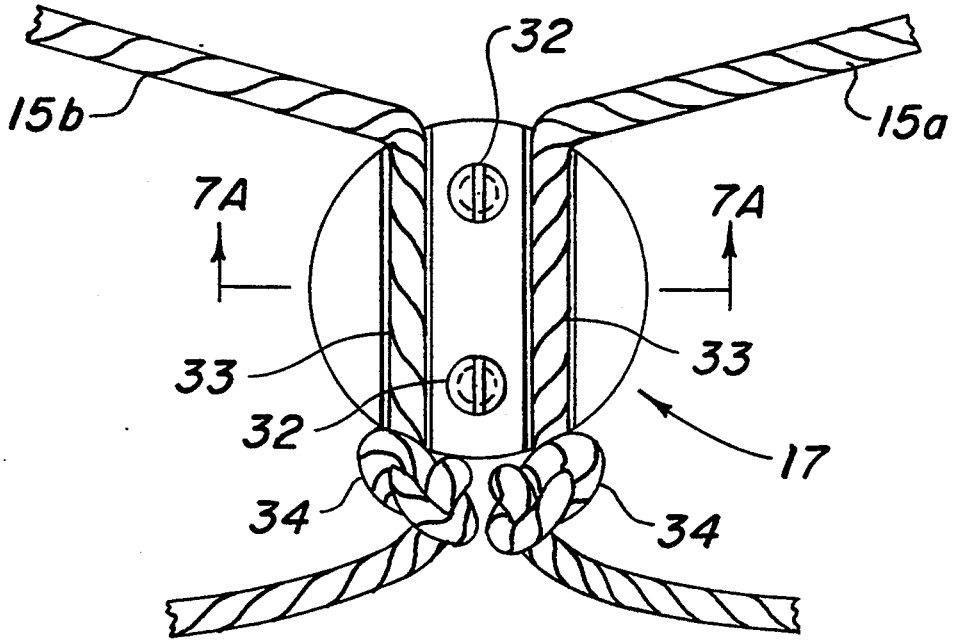
FIGS. 7 and 7A are plan and sectional views respectively, of a preferred form of quick release cleat used for the control line in the invention.
Figure 7A:
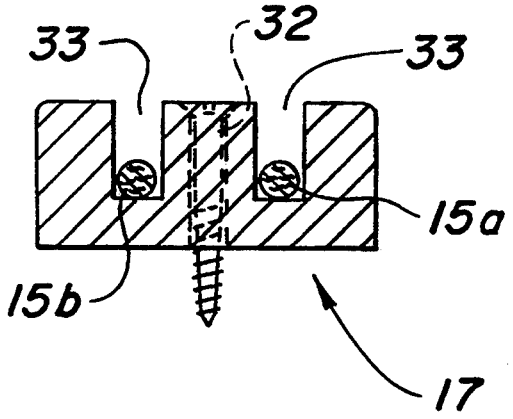

Although other means may be employed, preferred attachment means for securing the line to the tiller is shown in FIG. 7 and 7A. Preferably, the securing means 17 comprises a cleat which is secured to the upper surface of the tiller by means of screws 32. The cleat has a pair of upwardly open slots 33 which are dimensioned to receive the ends of line 15. To prevent the line from slipping through the slots and to provide the desired degree of tension in the line, stop means, preferably in the form of figure-eight knots 34, are provided, as can be seen at 34 in FIG. 2. The knots 34 serve as stops which hold the line in fixed position within the slots of the cleat. An upward pull on the ends of each line substantially instantaneously disables the rudder control system should the helmsman decide that he wants to control the craft free of the restraints introduced by the control system. It can be understood that adjustment of line tension is simply provided by change of position of knots 34.

Figure 8:
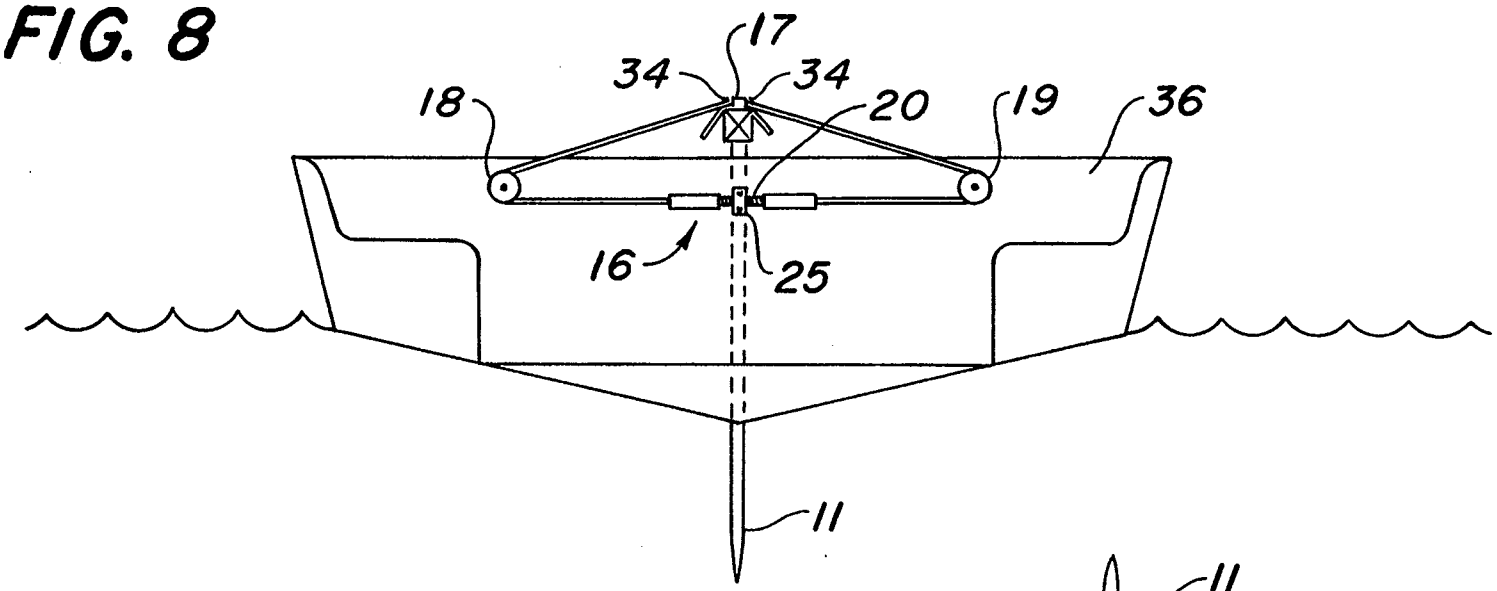
FIG. 8 is an elevational/sectional view showing an alternative mounting for the rudder control system of the invention.
Figure 8A:
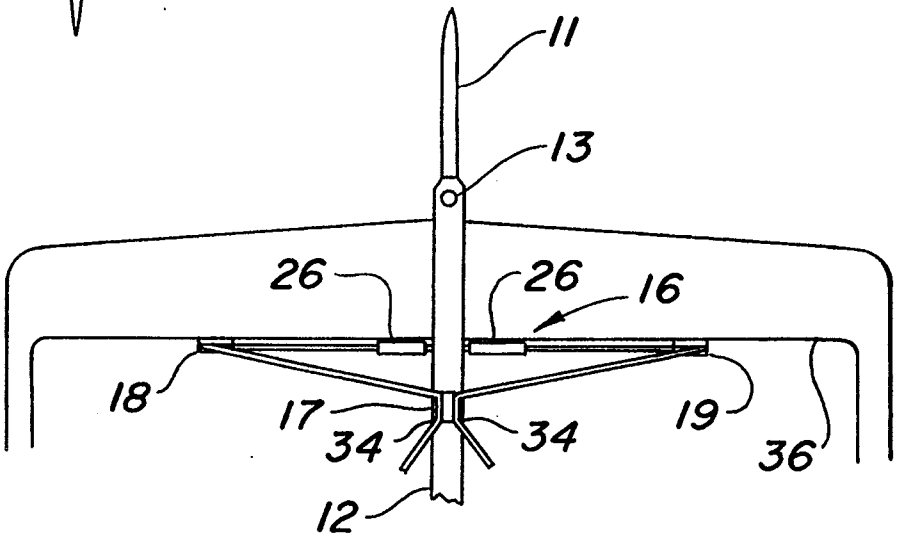
FIG. 8A is a plan view of the rudder control system as illustrated in FIG. 8.

FIGS. 8 and 8A illustrate a modified position for mounting the rudder control system as compared with the position of FIGS. 1 and 2. According to FIGS. 8 and 8A, the spools 18 and 19 are mounted on the inner vertical surface of transom 36. Center stop member 25 is mounted on the transom centrally of the two spools. Control line portions 15*a* and 15*b* extend from a cleat on the tiller as shown at 17 around the spools 18 and 19 to the resilient means 16. The control system of FIGS. 8 and 8A controls the tiller as described above.

A preferred form of guide spool is illustrated in FIGS. 6 and 6A. Preferably, each guide spool 18 and 19 comprises a plate 38 and a spool portion 39, both of which are affixed to the hull by suitable fasteners. Plate 38 has an upwardly extending lip or fairlead 40 which is effective to retain the line 15 in contact with the curved surface of each spool portion 39.

Figure 9:
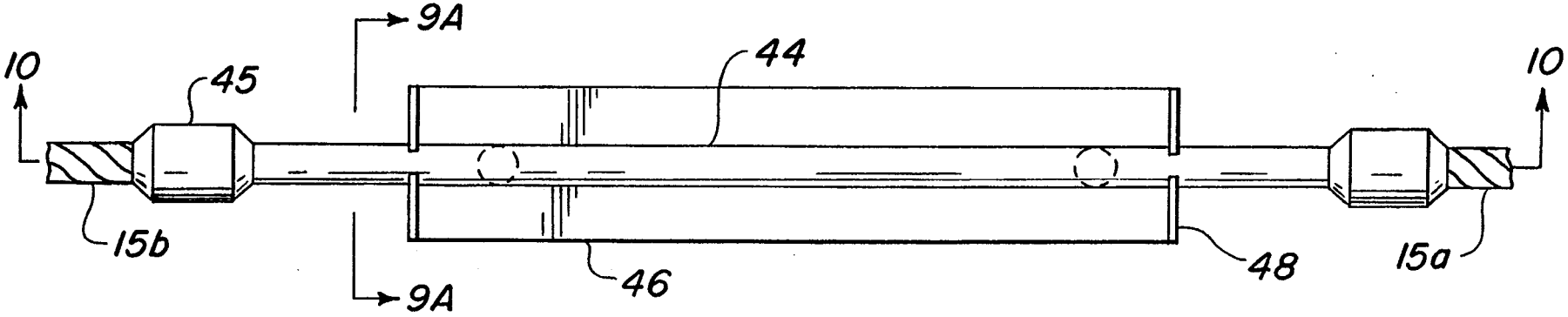
FIG. 9 is a view of an alternative form of resilient device and associated stop means incorporating the principles of the invention.
Figure 9A:
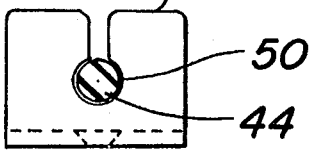
FIG. 9A is a sectional view taken along line 9A—9A of FIG. 9.
Figure 10:
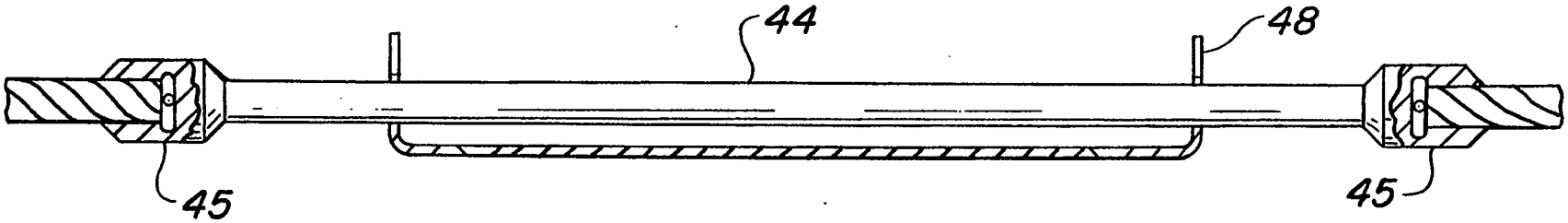
FIG. 10 is a plan view of the device of FIG. 9.

FIGS. 9, 9A and 10 disclose an alternative form of resilient connecting means and an alternative stop means for use in carrying out the objectives of the invention. According to FIGS. 9, 9A and 10, the resilient means comprises an elastic cord 44 having enlarged end portions 45 which are secured to the ends of line portions 15*a* and 15*b*. Preferably, the center stop means comprises a bracket 46 having vertically extending end portions 48, each of which has a groove 50 through which the resilient cord 44 is guided. Enlarged cord ends 45 serve as stops which interengage with the bracket end surfaces in response to tiller movements beyond the predetermined range.

It should be understood that the degree of tension introduced into line 15 may be varied by relocating the positions of the knots 34. The degree of tension in turn varies the frictional forces acting between the guide surface of spools 18 and 19 and the line 15, thereby varying the resistance to turning motion provided to the tiller. For example, the helmsman may wish to introduce a greater degree of tension into the system during heavy weather conditions than would be the case in light air. It should also be understood that although the stop means has been shown to be positioned centrally of the boat hull, separate stop members affixed to the hull operating in conjunction with the protuberances on the line portions 15*a* and 15*b* at other positions along the length of the line may be employed.

The system is easy to install, is simple to adjust and use and can readily be mounted in position in which it does not interfere appreciably with the operations of the boat. It can be substantially instantaneously disengaged and is useful for maintaining the rudder in a center position and for urging a return of the rudder to a central position, thereby avoiding erratic and potentially unsafe movements of the craft. Still further, the invention is useful for maintaining the rudder in a steady position during mooring or when the boat is to be trailered.

I claim:

1. A rudder control system for a boat rudder pivotally mounted with respect to a boat hull and having a steering arm connected thereto comprising:

rudder control line means comprising first and second control line sections;

means affixing the control line sections to the steering arm at a position displaced along the axis of the steering arm from the pivotal mounting, said first control line section being extended in a first path from the steering arm towards one side of the boat hull and said second control line section being extended in a second path from the steering arm towards the opposite side of said boat hull;

means for frictionally resisting turning movements of the rudder, including first and second guide members for said first and second control line sections, respectively, said first and second guide members each having a fixed guide surface engageable with the respective section of the control line for guiding the respective first and second sections of the control line from the guide members into converging paths;

axially expandable resilient tensioning means interconnecting the first and second control line sections in said converging paths for maintaining a predetermined line tension; and stop means interacting with said line sections for limiting movement of said line sections to a predetermined range of movements, said resilient tensioning means providing a tensioning force acting to return said steering arm and said rudder towards a position within said predetermined range established by said stop means.

2. A rudder control system according to claim 1, wherein each said guide surface has a relatively high coefficient of friction for frictionally resisting relative motion of the control line.

3. A rudder control system according to claim 2, further including rudder return means associated with said resilient means, said rudder return means including first and second stops on said first and second line sections and moveable therewith and said stop means affixed to said boat hull and interengageable with said first stop to limit movement of said first line section upon movement of said second line section away from second guide means and engageable with said second stop to limit movement of said second line section upon movement of said first line section away from said first guide means.

4. A rudder control system according to claims 3, wherein said means for affixing the control line to the steering arm comprise a cleat on said steering arm.

5. A rudder control system according to claim 4, wherein said stops are adjustable lengthwise of the control line for adjustment of control line tension forces.

6. A rudder control system according to claim 5, wherein the resilient means is an elastic cord.

7. A rudder control system according to claim 5, wherein the resilient means is a coil spring.

8. A rudder control system according to claim 7, wherein said stop means comprises a guide ring member affixed to said boat hull, said guide ring member having an opening positioned and dimensioned for free passage of said coil spring, wherein said first and second stops each comprise a tubular device having a passage dimensioned to receive one end of said coil spring, the respective line section and the coil spring being interconnected within the tubular device, the respective line section further being secured to the tubular device.

9. In a rudder control system for a boat rudder and having a steering arm interconnected to the rudder extending generally axially of the boat hull, said control system further including means pivotally mounting the rudder and the steering arm with respect to the hull for imparting turning movements to the rudder by corresponding movements of the steering arm from a generally central position extending axially of the hull towards and away from the sides of the hull;

said control system further comprising rudder control line means, said control line means comprising first and second control line sections, means affixing the control line sections to the steering arm at a position displaced along the axis of the steering arm from the pivotal mounting means, said first control line section extended in a first path from the steering arm towards one side of the boat hull and said second control line section extended in a second path from the steering arm towards the opposite side of said boat hull;

first and second guide members in said first and second paths respectively, said first and second guide members each having a fixed guide surface engageable with the respective control line section for guiding the respective first and second control line sections from the guide members in converging paths; and axially expandable resilient tensioning means interconnecting the first and second control line sections in said converging paths for maintaining a predetermined tension in the said control line means for resiliently countering movements of said steering arm away from said central position.

10. A rudder control system according to claim 9 wherein each said guide surface has a relatively high coefficient of friction for frictionally resisting relative motion of the control line.

11. A rudder control system according to claim 10, further including rudder return means associated with said resilient means, said rudder return means including first and second stops on said first and second line sections and moveable therewith and stop means affixed to said boat hull and interengageable with said first stop to limit movement of said first line section upon movement of said second line section away from said second guide means and engageable with said second stop to limit movement of said second line section upon movement of said first line section away from said first guide means.

12. A rudder control system according to claim 11, wherein said means for affixing the control line to the steering arm comprise a cleat on said steering arm.

13. A rudder control system according to claim 12, wherein said cleat includes a pair of upwardly open slots for receiving said first line sections, said first and second line sections each having a terminal end portion and a protuberance between the slot and the end portion for preventing passage of the line section through the respective slot towards its associated guide means.

14. A rudder control system according to claim 13, wherein said protuberances are adjustable lengthwise of the control line for adjustment of control line tension forces.

15. A rudder control system according to claim 14, wherein the resilient means is an elastic cord.

16. A rudder control system according to claim 12, wherein the resilient means is a coil spring.

17. A rudder control system according to claim 16, wherein said stop means comprises a guide ring member affixed to said boat hull, said guide ring member having an opening positioned and dimensioned for free passage of said coil spring, wherein said first and second stops each comprise a tubular device having a passage dimensioned to receive one end of said coil spring, the respective line section and the coil spring being interconnected within the tubular device, the respective line section further being secured to the tubular device.

* * * * *